US011339598B2

(12) United States Patent
Milligan et al.

(10) Patent No.: US 11,339,598 B2
(45) Date of Patent: May 24, 2022

(54) WINDOW VENT ASSIST MECHANISM FOR VENT WINDOW ASSEMBLY

(71) Applicant: Caldwell Manufacturing Company North America, LLC, Rochester, NY (US)

(72) Inventors: Patrick E. Milligan, Rochester, NY (US); Andrew Baglio, Rochester, NY (US); Nathan C. Serfass, Rochester, NY (US); James M. McInnis, Rochester, NY (US)

(73) Assignee: Caldwell Manufacturing Company North America, LLC, Rochester, NY (US)

( * ) Notice: Subject to any disclaimer, the term of this patent is extended or adjusted under 35 U.S.C. 154(b) by 269 days.

(21) Appl. No.: 16/547,805

(22) Filed: Aug. 22, 2019

(65) Prior Publication Data

US 2020/0071979 A1 Mar. 5, 2020

Related U.S. Application Data

(60) Provisional application No. 62/724,731, filed on Aug. 30, 2018.

(51) Int. Cl.

| | |
|---|---|
| ***E05F 1/10*** | (2006.01) |
| ***E05D 15/40*** | (2006.01) |
| ***E05F 7/00*** | (2006.01) |

(52) U.S. Cl.

CPC ..... *E05F 1/105* (2013.01); *E05D 15/40* (2013.01); *E05F 1/1016* (2013.01); (Continued)

(58) Field of Classification Search

CPC ..... E05D 15/28; E05D 15/30; E05D 15/40; E05F 1/105; E05F 1/1016; E05F 1/1083; (Continued)

(56) References Cited

U.S. PATENT DOCUMENTS 2,255,769 A 9/1941 Gallagher
2,698,173 A * 12/1954 Rydell ..... E05F 1/1058 49/342

(Continued)

FOREIGN PATENT DOCUMENTS

DE 3228699 A1 2/1983
EP 3045635 A1 7/2016

(Continued)

OTHER PUBLICATIONS

1678 Snubber Assembly, Caldwell, www.caldwellmfgco.com, circa. 2018.

*Primary Examiner* — Justin B Rephann
(74) *Attorney, Agent, or Firm* — Harness, Dickey & Pierce, P.L.C.

(57) ABSTRACT

A window vent assist mechanism for use with a vent window operable in a closed position and in a vented position can include a first support configured to connect to a header of a window frame and a second support configured to connect to an upper rail of a window vent disposed in the window frame. The window vent assist mechanism also includes a biasing member disposed between the header of the window frame and the upper rail of the window vent and nearer to an inner side of the vent window and a center of gravity of the window vent. The biasing member is configured to exert a force to urge the window vent to move relative to the window frame to reduce an operating force required to move the window vent to the vented position.

18 Claims, 9 Drawing Sheets

(52) U.S. Cl.
CPC ..... *E05F 1/1083* (2013.01); *E05F 7/005* (2013.01); *E05Y 2900/148* (2013.01)

(58) Field of Classification Search
CPC ..... E05F 7/005; E05F 1/1058; E05F 1/1033; E05F 1/1008; E05F 1/1041
See application file for complete search history.

(56) References Cited

U.S. PATENT DOCUMENTS

| | | | | |
|---|---|---|---|---|
| 3,476,280 | A | 11/1969 | Phillips | |
| 4,012,008 | A | 3/1977 | Hosooka | |
| 4,512,600 | A | 4/1985 | King | |
| 5,205,073 | A * | 4/1993 | Lyons, Sr. | E02D 29/1418 49/379 |
| 9,528,311 | B1 * | 12/2016 | Hager | E05B 65/006 |
| 10,246,925 | B2 * | 4/2019 | Vetter | E05F 7/005 |
| 10,711,510 | B2 * | 7/2020 | Niehausmeier | E06B 3/5018 |
| 2008/0000164 | A1 * | 1/2008 | Erickson | E06B 5/113 49/394 |
| 2010/0043299 | A1 * | 2/2010 | Vetter | E05F 7/005 49/401 |
| 2012/0036783 | A1 | 2/2012 | Ryberg et al. | |
| 2014/0230330 | A1 * | 8/2014 | Piermee | E02D 29/1418 49/279 |
| 2015/0218773 | A1 | 8/2015 | Bravo et al. | |
| 2018/0163453 | A1 * | 6/2018 | Attee | B63B 19/14 |

FOREIGN PATENT DOCUMENTS

| | | | |
|---|---|---|---|
| EP | 3045636 | A1 | 7/2016 |
| GB | 190908791 | A | 2/1910 |
| GB | 595229 | A | 11/1947 |
| GB | 611693 | A | 11/1948 |
| GB | 793751 | A | 4/1958 |
| GB | 2133831 | A | 8/1984 |
| GB | 2295634 | A | 6/1996 |
| GB | 2378974 | A | 2/2003 |
| GB | 2398097 | A | 8/2004 |
| WO | 2013/135545 | A1 | 9/2013 |
| WO | 2014/187753 | A1 | 11/2014 |

* cited by examiner

WINDOW VENT ASSIST MECHANISM FOR VENT WINDOW ASSEMBLY

CROSS-REFERENCE TO RELATED APPLICATION

This application claims the benefit and priority of U.S. Provisional Application No. 62/724,731, filed on Aug. 30, 2018. The entire disclosure of the above application is incorporated herein by reference.

FIELD

The present disclosure relates to vent window assemblies, and more particularly to window vent assist mechanisms for use to aid in the movement of a window vent.

BACKGROUND

Vent window assemblies often include a vent that is operative to move relative to a window frame. The window vent can be moved to a vented (or opened) position to permit air to move through the window assembly. Such window assemblies can include manually operated control assemblies that assist a user in moving the window vent from a closed position to the vented (or opened) position.

The combined weight of the glass and structural members (e.g., the frame) of the window vents can be significant. Such weights can make movement of the window vents difficult for many users. Moreover, architectural designs are creating trends for larger and more thermally-efficient window vents which increase the weight of the window vent.

There exists a need, therefore, for improvements in window assemblies to reduce the force required by a user to move a window vent in a window assembly between the closed and vented positions.

The background description provided here is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

SUMMARY

In one example in accordance with the present disclosure, a window vent assist mechanism is provided for use with a vent window operable in a closed position and in a vented position. The example window vent assist mechanism includes a first support configured to connect to a window frame and a second support configured to connect to a window vent disposed in the window frame. The example window vent assist mechanism also includes a biasing member disposed between the first support and the second support. The biasing member is configured to urge the second support to move relative to the first support to reduce a force required by a user to move the window vent relative to the window frame, particularly from the closed to the vented (or opened) position.

In another aspect of the present disclosure, a window vent assist mechanism is provided for a vent window for reducing a force required to move a window vent relative to a window frame from a closed position to an opened position. The window vent assist mechanism includes a first support plate configured to attach to a header of a window frame, a second support plate configured to attach to an upper rail of a window vent disposed in the window frame, and a biasing member disposed intermediate the first support plate and the second support plate. The first support place includes a first seat for receiving a first end of the biasing member and the second support plate includes a second seat for receiving and retaining a second end of the biasing member. The window vent assist mechanism is moveable between a biased condition when the window vent is in the closed position and an unbiased condition when the window vent is in the vented position. When the window vent assist mechanism is in the biased condition the first support plate and the second support plate are positioned in an opposed relationship such that the first seat and the second seat are co-axially aligned along a vertical axis and the window vent assist mechanism imparts a force against the first support plate and the second support plate to urge the second support plate away from the first support plate.

In still another aspect of the present disclosure, the first support plate has a first inner side and the first seat includes a first opening extending through the first support plate along the vertical axis. The first opening is defined by a first retaining wall extending about a perimeter of the first opening and a conical guide wall disposed between the first retaining wall and the first inner side. A surface of the guide wall is disposed at an acute angle relative to the vertical axis. The first end of the biasing member is disposed in the aperture.

In still another aspect of the present disclosure, the second support plate has a second inner side and the second seat includes a second opening extending through the second support plate along the vertical axis. The second opening is defined by a second retaining wall extending about a perimeter of the second opening and a ledge extending from the second retaining wall into the opening. The ledge terminates at an edge. The second end of the biasing member is disposed in the aperture and the ledge engages the biasing member to retain the biasing member in the second seat.

In yet another aspect of the present disclosure, the biasing member defines an outer perimeter and the edge of the ledge intersects the outer perimeter. The biasing member can be a compression coil spring and the ledge can extend between two adjacent coils of the compression coil spring to retain the biasing member in the second seat.

In yet another aspect of the present disclosure, the second support plate further includes a boss projecting from the second inner surface toward the first support plate and the first support plate has a recess. When the window vent assist mechanism is in the biased condition the boss is received in the recess in a nesting relationship.

In still another aspect of the present disclosure, a vent window assembly is provided and includes an outer side, an inner side, a window frame, a window vent disposed in the window frame and moveable from a closed position and an opened position and a window vent assist mechanism. The window frame includes a header, the window vent includes a horizontal upper rail, a horizontal lower rail, opposing vertical stiles and a plurality of panes of glass, and the first support plate is attached to the header and the second support plate is attached to the upper rail of the window vent such that the vertical axis is located closer to the inner side of the vent window assembly than a vertical plane in which a center of gravity of the window vent is located.

In another aspect of the present disclosure, the examples and principles of the present disclosure provide a window vent assist mechanism that can be incorporated into vent window assemblies of different sizes and different weights. The window vent assist mechanisms can be used to reduce the force required by a user to move the window vent in the vent window assembly, especially from the closed position to the vented (or opened) position.

In still another aspect of the present disclosure, the examples and principles of the present disclosure provide a window vent assist mechanism that can be incorporated into a vent window assembly to enable the window vent in the vent window assembly to be moved by a user from the closed position to the vented position with a force of less than five pounds.

Further areas of applicability of the present disclosure will become apparent from the detailed description, the claims, and the drawings. The detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings.

In the drawings, reference numbers may be reused to identify similar and/or identical elements.

DETAILED DESCRIPTION

Figure 1:
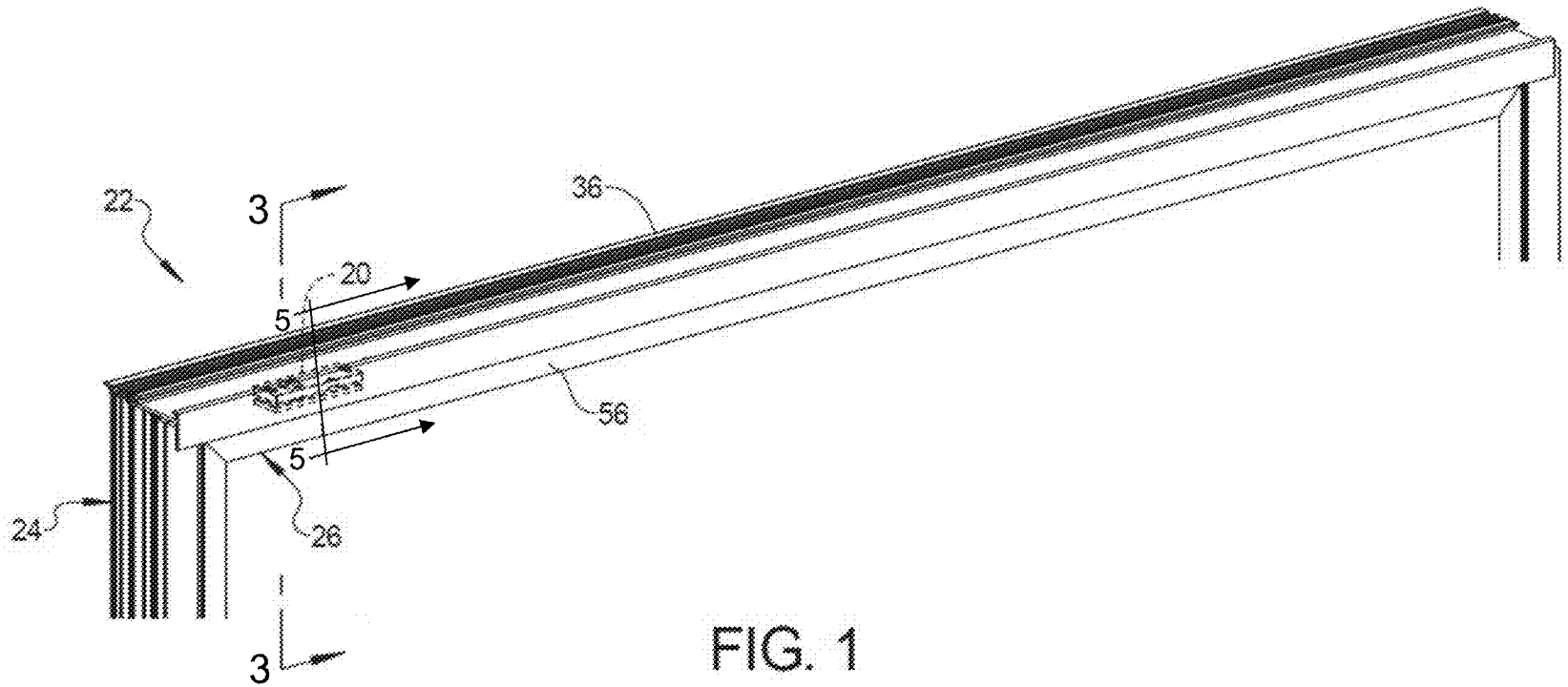
FIG. 1 shows a partial perspective view of the upper portion of an exemplary vent window assembly including a window vent assist mechanism in accordance with the present disclosure and shown with the window vent in a closed position.
Figure 2:
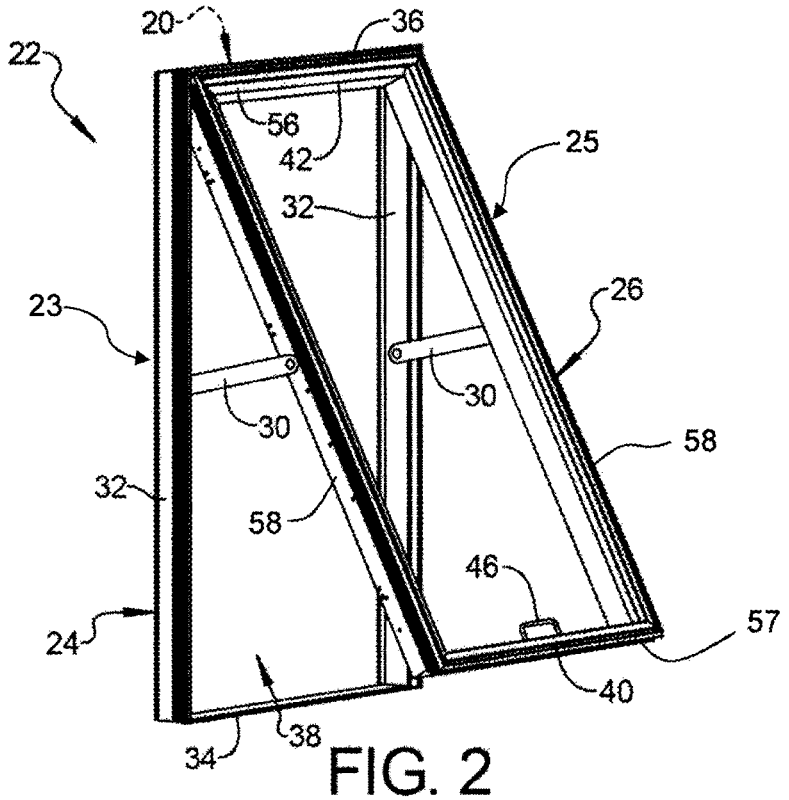
FIG. 2 is an illustration of a complete vent window assembly that includes the window vent assist mechanism of FIG. 1 and shown with the window vent in a vented or open position.

As shown in FIGS. 1 and 2, an example window vent assist mechanism 20 is depicted as part of a window assembly 22. The example window vent assist mechanism 20 can be used in connection with various types of window assemblies. In the example shown, the window assembly 22 is an awning window assembly. The window assembly 22 can include a window frame 24, a window vent 26, and a hinge 30. As is well-known, the window assembly has an inner side 23 exposed to an inside or controlled environment and an outer side 25 exposed to an outside or uncontrolled environment. The window vent 26 is moveable from a closed position where the window assembly 22 serves to close or separate the inside environment from the outside environment to an opened or vented position where the window assembly 22 opens the inside environment to the outside environment.

The window frame 24, in the example shown, has a rectangular shape and includes two opposing vertical sides 32, a base 34 and a frame header 36. The base 34 and the frame header 36 can be horizontal beams that are positioned substantially parallel to one another. Together, the vertical sides 32, the base 34 and the frame header 36 define a window opening 38. The window frame 24 can be mounted into a wall or other structure to connect the window assembly 22 at a desired location in a residential, commercial or other structure.

The window vent 26, in this example, has a shape that cooperates with the window frame 24. As shown, the window vent 26 can be mounted into the window opening 38 of the window frame 24. The window vent 26 is connected to the window frame 24 by the hinge 30. The hinge 30 can be any suitable linkage or other mechanism that permits the window vent 26 to move relative to the window frame 24. In the example shown, the window assembly 22 is an awning window. In this type of window, the window vent 26 articulates relative to a plane P (FIG. 3) defined by the window opening 38 of the window frame 24. The window vent 26 can translate relative to the closed position of the window vent 26 in which the window vent 26 is positioned to substantially cover the window opening 28. The window vent 26 can also rotate relative to the plane P of the window opening 38. The window vent 26 can move from the closed position (FIG. 1) to an opened or vented position (FIG. 2) in which at least a portion of the window vent 26 is separated or spaced apart from the window opening 38. In the example shown, the bottom portion 40 of the window vent 26 has moved a greater distance from its original position in the window opening 28 than the top portion 42 of the window vent. In this example vented position, the window vent 26 is positioned at an oblique angle A (FIG. 4) relative to the plane P of the window opening 38.

As can be appreciated, the principles and various aspects of the present disclosure can be used on other types of window assemblies and in other positions other than in the examples described below. For example, the window vent assist mechanisms of the present disclosure can also be used in casement windows, transom windows and the like.

In the example shown, the window vent 26 can be moved in the window frame 24 using the handle 46. The handle 46 can be any suitable knob, bar, grip or the like that permits a user to move the window vent 26. In other examples, the window assembly 22 can include a control assembly or other linkage, drive assembly, window stay or the like that is attached to the window vent 26 and can be used to move the window vent 26 relative to the window frame 24. The control assembly can also include one or more detents, holes, or other positioning features that can retain the window vent 26 in a desired position relative to the window frame 24. In the example shown, the handle 46 is manually operated. A user pushes (or pulls) on the handle 46 to move the bottom portion 40 of the window vent 26 away from (or towards) the base 34 of the window frame 24.

The window vent 26 can move and/or rotate about a hinge plane H. The hinge plane H is a plane defined by the location at which the hinges 30 are mounted to the window frame 24. In various examples, the hinge plane H can be located at various positions relative to the center of gravity of the window vent 26. The distance of this offset between the center of gravity of the window vent 26 and the hinge plane H can affect the magnitude of the force required to move the window vent 26 relative to the window frame 24. It is desirable in some circumstances, such as in residential or commercial structures, to keep the magnitude of the force required to move the window vent 26 to a force less than or equal to five pounds (22.2 N). In other circumstances, it can be desirable to maintain the desired window operating force (i.e., the force required to move the window vent 26 relative to the window frame 24) to other force levels. In other examples, the desired window operating force can be a force less than 10 pounds (44.5 N). In another example, the desired window operating force can be a force less than 8.5 pounds (37.7 N). In another example, the desired window operating force can be a force less than 7 pounds (31.1 N). In still another example, the desired window operating force can be a force less than 6 pounds (26.7 N).

Figure 3:
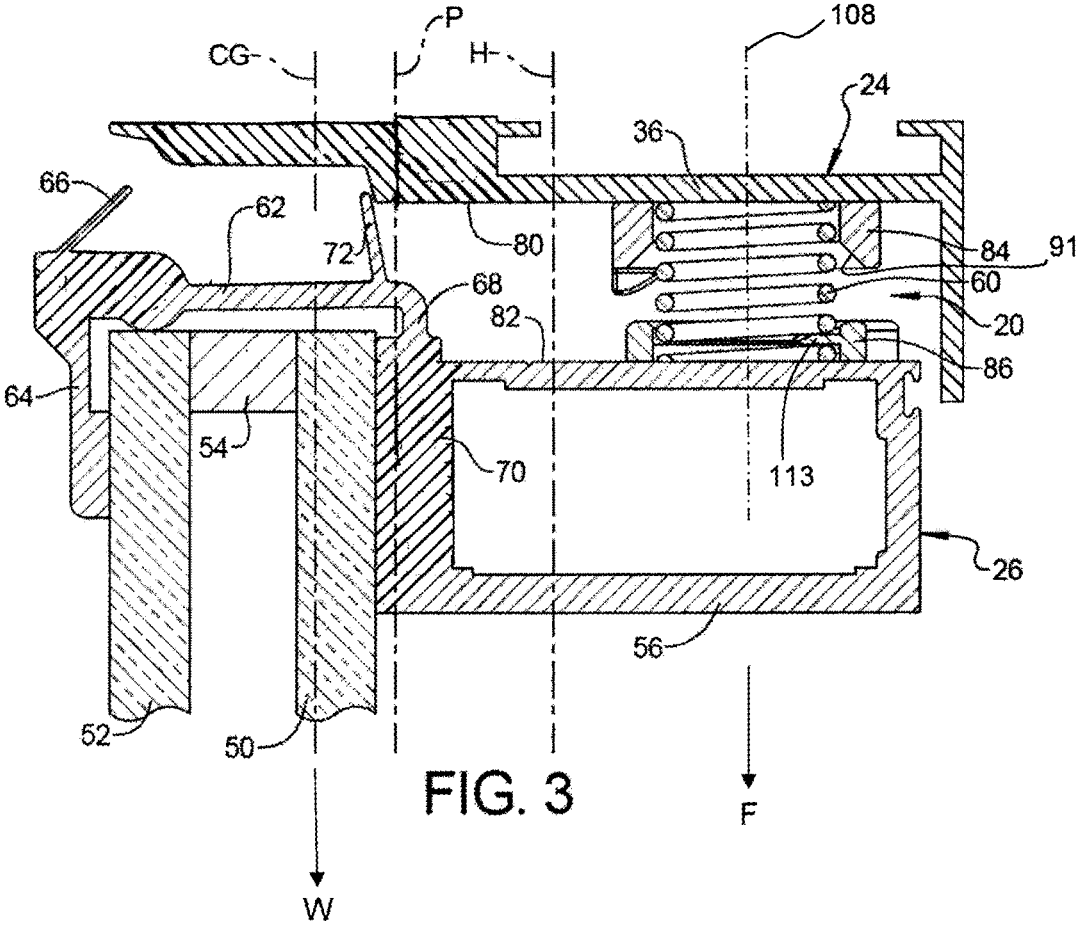
FIG. 3 is a partial cross-sectional view of the vent window assembly including the window vent assist mechanism taken along the line 3-3 of FIG. 1 and showing the window vent in a closed position and the window vent assist mechanism in a compressed (i.e., biased) condition.

Referring now to FIG. 3, a partial cross-section of the window assembly 22 is shown. As can be seen, the window vent assist mechanism 20 is positioned in the window assembly 22 between the header 36 of the window frame 24 and the window vent 26 and behind (i.e., toward the inner side 23 of the window assembly 22) the hinge plane H and the vertical plane CG (in which the center of gravity of the window vent 26 is located when the window vent 26 is in the closed position, as shown in FIG. 3).

Figure 4:
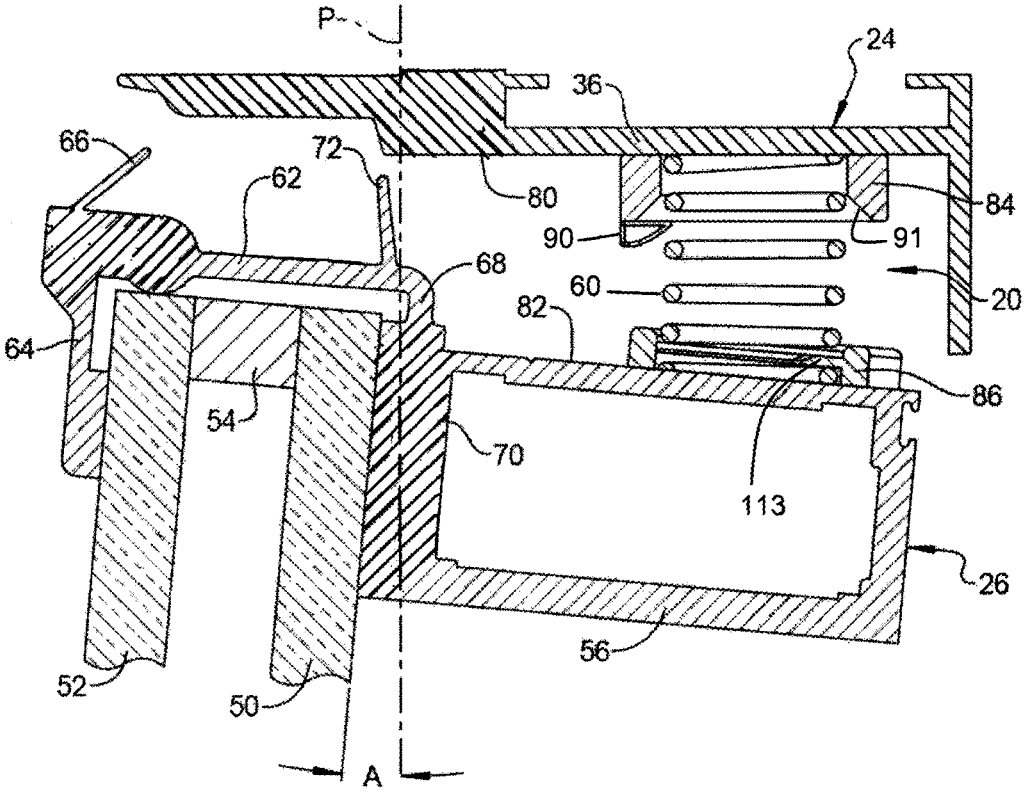
FIG. 4 is a partial cross-sectional view of the vent window assembly including the window vent assist mechanism similar to FIG. 3 but showing the window vent in a vented (or opened) position and the window vent assist mechanism in a relaxed (i.e., unbiased) condition.

As shown, the window vent 26 generally has a frame including an upper horizontal rail 56, a lower horizontal rail 57 and two opposing vertical stiles 58 surrounding one or more panes of glass. As shown in FIGS. 3 and 4, the window vent is a double-pane vent and includes a first glass pane 50 and a second glass pane 52. The first glass pane 50 and the second glass pane 52 are separated from one another by a spacer 54. The first glass pane 50 and the second glass pane 52 are mounted to the cross-bars 57, 56 and the stiles 58 of the window vent using a structural glazing attachment method. In this construction method, the first glass pane 50 and/or the second glass pane 52 are bonded and/or anchored to the window vent 26 rather than being captured in the structure of the window vent 26. In other examples, first glass pane 50 and/or the second glass pane 52 can be captured in the window vent 26 by additional structural members.

In the example shown, the first glass pane 50 is positioned adjacent to the upper rail 56 of the window vent. The upper rail 56 can be a rectangular hollow beam. The cross-bars 56, 57 and stiles 58 can be made of any suitable structural material such as aluminum, vinyl, fiberglass or the like.

The window vent 26 can include one or more sealing elements that are positioned around or are attached to the first glass pane 50 and/or the second glass pane 52. In the example shown, the window vent 26 includes an upper seal 62, a face seal 64 and a finger seal 66. The upper seal 62 can be attached to the upper rail 56 by an attachment arm 68. The attachment arm 68 can extend from a wall 70 of the upper rail 56. Alternatively, the attachment arm 68 can be attached to the wall 70 by an interference fit, adhesive, fastener or other suitable attachment. The upper seal 62 can extend across an upper surface of the first glass pane 50, the spacer 54 and/or the second glass pane 52. One or more ribs 72 can project away from the first glass pane 50, the spacer 54 and/or the second glass pane 52 toward the window frame 24.

The face seal 64 can connect to the upper seal 62 and/or to the second glass pane 52. The face seal 64 is positioned on a side of the second glass pane 52 opposite to the upper rail 56. The face seal 64 can include the finger seal 66. Alternatively, the finger seal 66 can be attached to the face seal 64 using an interference fit, adhesive, fastener or other suitable attachment. The finger seal 66 projects away from the window vent 26 toward the window frame 24.

The upper seal 62, the face seal 64 and/or the finger seal 66 can be made of a suitable elastomeric material such as a natural or synthetic rubber. The upper seal 62, the face seal 64 and/or the finger seal 66 can elastically deform and can be used to seal the joint between the window vent 26 and the window frame 24. When the window vent 26 is positioned in the closed position, the upper seal 62, the face seal 64 and/or the finger seal 66 can contact the window frame 24 and prevent and/or minimize the intrusion of rain, snow, wind, or other environmental elements.

In the configuration shown, the location of the first glass pane 50 and the second glass pane 52 relative to the upper rail 56 causes the center of gravity of the window vent 26 to lie horizontally offset from the upper rail 56 in a direction toward the outer side 25 of the window assembly 22. The center of gravity of the window vent 26, in the example shown, passes approximately through the vertical plane CG. The window vent 26 is attached to the window frame 24 at the hinge plane H. Since the vertical plane CG of the center of gravity of the window vent 26 is horizontally offset from the hinge plane H, the weight W of the window vent 26 tends to bias the window vent 26 toward the closed position. Consequently, to move the window vent 26 from the closed position to the vented position (FIG. 2), the user must supply a force to overcome the bias tending to keep the window vent 26 in the closed position. Given this condition, the force required by a user to move the window vent 26 from the closed position to the vented position can be greater than the desired window operating force. The window vent assist mechanism 20, then, is positioned between the window vent 26 and the window frame 24 nearer to the inner side 23 of the window assembly 22. The window vent assist mechanism 20 can operate in and between a compressed condition when the window vent is in the closed position (see, e.g., FIG. 3) and a relaxed condition when the window vent is in the vented position (see, e.g., FIG. 4). In a compressed condition the window vent assist mechanism 20 operates to produce a force F to counter the weight W of the window vent 26 which tends to bias the window vent 26 toward the closed position and, consequently, helps to reduce the window operating force for moving the window vent 26 to the vented position to a value within a desired or specified range.

The frame header 36 of the window frame 24 can include a core wall 80 that is positioned substantially parallel to an opposing wall 82 of the when the window vent 26 is in the closed position. The window vent assist mechanism 20 can be positioned between the core wall 80 and the opposing wall 82. In the example shown in FIGS. 1-8, the window vent assist mechanism 20 includes a first upper support or frame plate 84 attached to the window frame header 36, a second lower support or rail plate 86 attached to the upper rail 56 of the window vent 26 and the biasing member 60 attached between the upper support 84 and the lower support 86. The upper support 84 and lower support 86 are positioned to oppose one another and capture the biasing member 60. The upper support 84 can be located adjacent to and be attached to the core wall 80 while the lower support 86 can be positioned adjacent to and be attached to the opposing wall 82. The biasing member 60 can be disposed between the upper support 84 and the lower support 86 and can extend along a vertical axis 108.

The biasing member 60 can be a compression coil spring. The compression coil spring can have a relaxed length that is greater than the distance between the core wall 80 and the opposing wall 82 when the window vent 26 is in the closed position. As such, the biasing member 60 is in a compressed state when the window vent 26 is in the closed position and is producing a bias or force against the upper support 84 and the lower support 86. In this manner, the biasing member 60 urges the window vent 26 to move from the closed position to the vented position. In other examples, the biasing member 60 can be other types of springs, elastomeric materials or other suitable elements that can generate a force against the window vent 26 and/or the window frame 24 when the window vent 26 is in the closed position. In addition, the bias of the biasing member 60 can be fixed or variable (e.g., a coil spring with a fixed spring rate or a variable spring rate).

Figure 5:
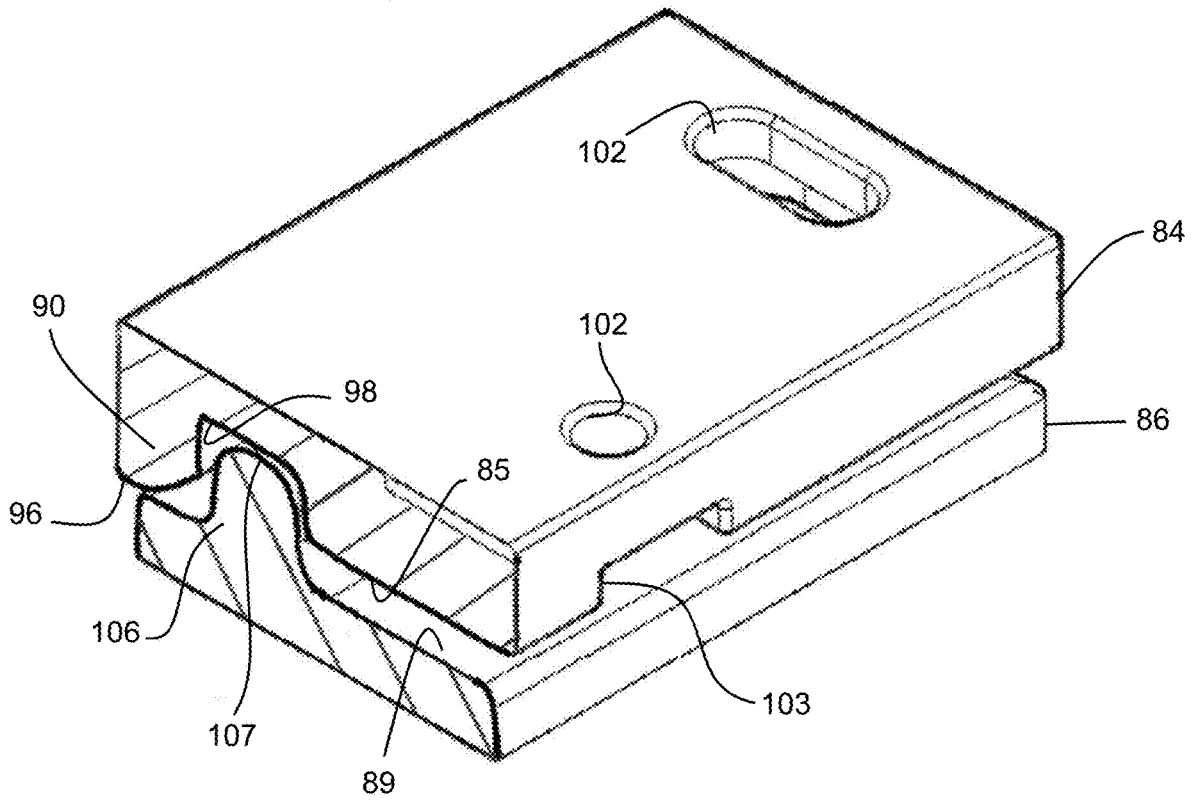
FIG. 5 is a cross-sectional perspective view of the window vent assist mechanism taken along the line 5-5 of FIG. 1 and showing the window vent assist mechanism in the biased (i.e., compressed) position.
Figure 7:
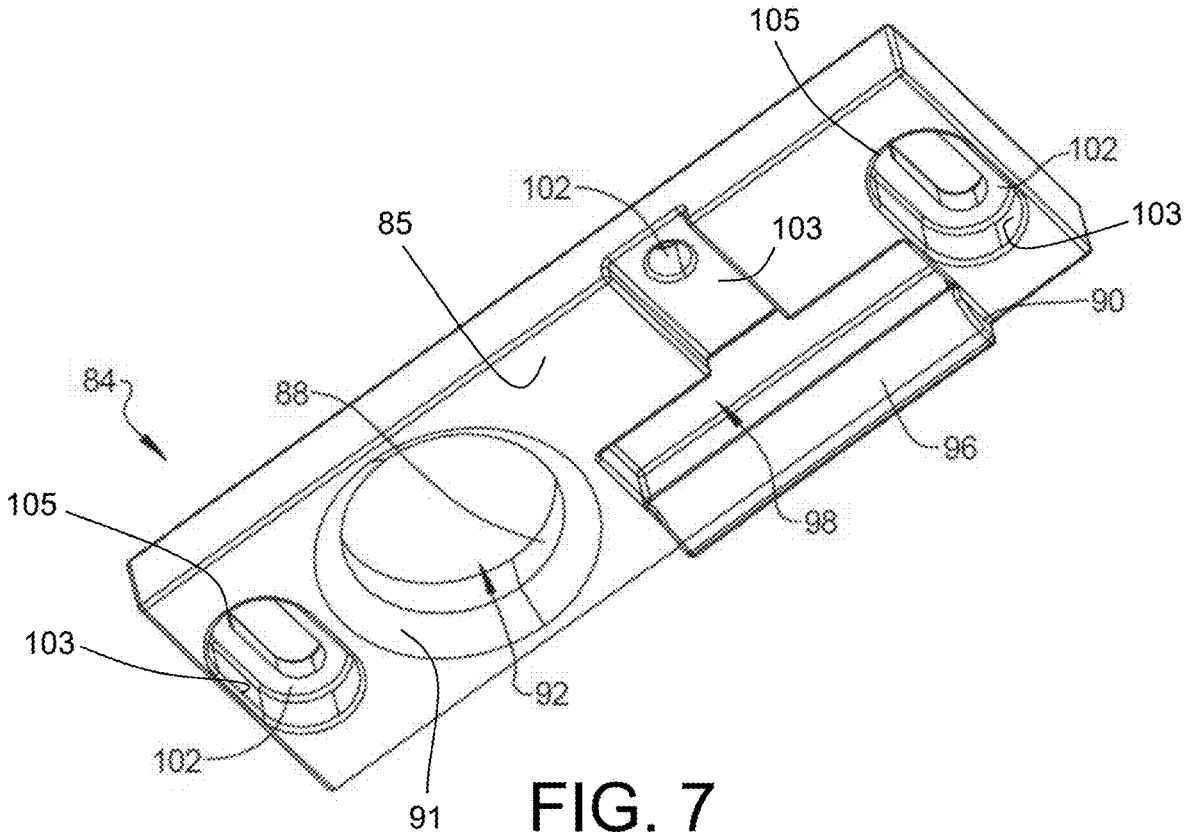
FIG. 7 is a perspective view of a first support of the window vent assist mechanism of FIG. 6.

The upper support 84, as shown in FIGS. 5 and 7, can have a generally rectangular cross-sectional profile and define an inner face 85. The inner face 85 of the upper support 84 can define a first seat 92 and a guide 90. The first seat 92 includes an opening through the upper support 84 that is defined by a first retaining wall 88 that can extend about a perimeter of the opening. The first seat 92 also includes a conical guide wall 91 located between the first retaining wall 88 and the first inner side 85. The guide wall 91 can be disposed at an acute angle relative to the vertical axis A, as best seen in FIGS. 3 and 4. A first end 94 of the biasing member 60 can be received in the first seat 92.

The first seat 92 and/or first retaining wall 88 can have a circular shape. In other examples, the first seat 92 and/or the first retaining wall 88 can have other shapes or profiles to coordinate with or complement a shape of the biasing member 60 (e.g., an outer perimeter of the biasing member 60). For example, the first retaining wall 88 and/or the first seat 92 can have a rectangular, square, oval or other suitable shape to receive and retain the biasing member 60 therein.

Figure 6:
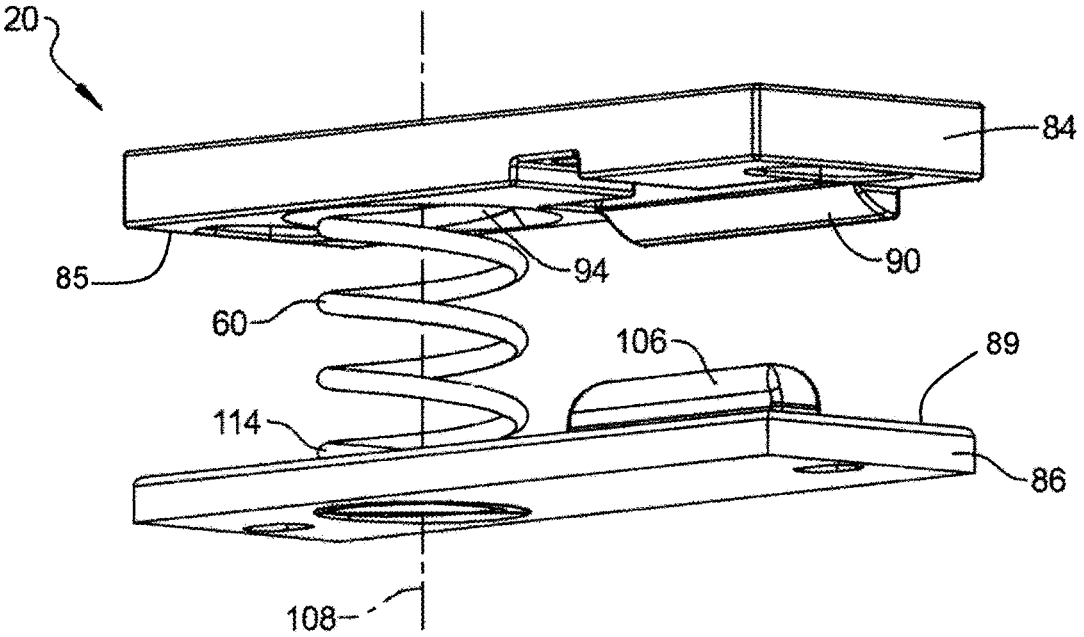
FIG. 6 is a perspective view of the window vent assist mechanism of FIG. 1 with the biasing member in an unbiased (i.e., relaxed) condition.

As best seen in FIGS. 5, 6 and 7, the guide 90 is an elongated projection or boss that projects outward from the inner face 85 of the upper support 84 toward the second support 86. In the example shown, the guide 90 has a smooth arcuate and/or rounded outer surface 96. The guide 90 is positioned adjacent to a depression or recess 98 extending into the inner face 85 of the upper support 84. The recess 98 can be a rectangular-shaped depression that is elongated in a direction generally parallel to the frame header 36 and or the upper rail 56. In other examples, the recess 98 can have shapes such as semi-spherical, semi-cylindrical, conical or frusto-conical. As will be further described below, the guide 90 can assist in directing a locator 106 (that is included on the second support 86) into the opening 98 when the window vent 26 moves from the vented position to the closed position and the vent window assist mechanism 20 moves from the relaxed condition to the compressed condition.

The upper support 84 can also include one or more attachment points 102. The attachment points 102 can be holes, recesses, slots or apertures that can accommodate fasteners (e.g., screws or rivets) or other attachment features such as clips, barbs, pins or the like that can be used to attach the first support 84 to the frame header 36 of the window frame 24. In the example shown, the attachment points 102 are through holes, including recesses or counter-sinks 103 from the inner surface 85, through which a fastener such as a screw, rivet, or the like can be inserted to retain the upper support 84 to the frame header 36. Two of the attachment points 102 also define elongated slots 105 which provide for some adjustability when attaching the support 84 to the window frame header 36.

The lower support 86 can have a shape and/or profile generally similar to the upper support 84. The lower support 86 can have a rectangular shape to coordinate with or complement the first support 84. The lower support 86 defines an inner face 89 that is positioned in an opposed relationship to the inner face 85 of the upper support 84. The inner face 89 of the lower support 86 can define a second seat and a locator 106. The second seat 112 includes an opening through the lower support 86 that is defined by a second retaining wall 104 that can extend about a perimeter of the opening. The second retaining wall 104 can be similarly configured to the first retaining wall 88. The first seat 92 and/or first retaining wall 88 and the second seat 112 and/or the second retaining wall 104 can be co-axially aligned along the axis 108 when the window vent assist mechanism 20 is in the compressed condition and the window vent 26 is in the closed position.

Figure 8:
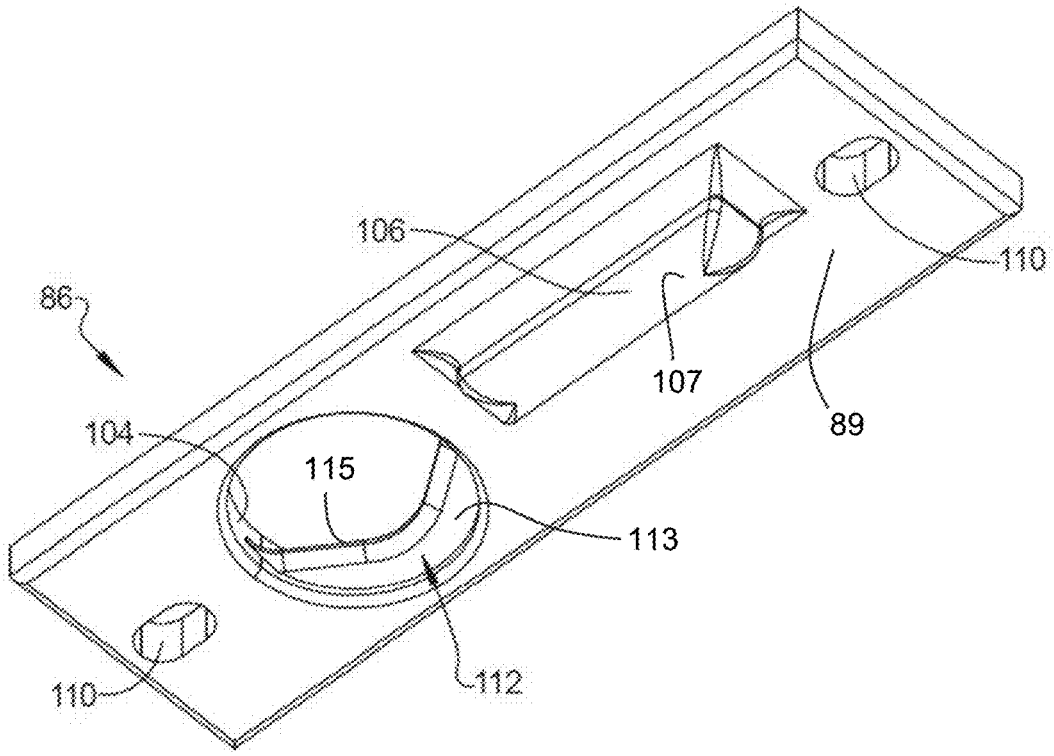
FIG. 8 is a perspective view of a second support of the window vent assist mechanism of FIG. 6.

Additionally, the second seat 112 can include a ledge 113. As best seen in FIG. 8, the ledge 113 can extend inward from the second retaining wall 104 and into the opening. The ledge 113 can extend at least partially across the opening and at least partially obstruct the opening. The ledge can terminate at an arcuate shaped edge 115. The ledge can have a thickness that is less than a height of the second retaining wall 104. A second end 114 of the biasing member 60 can be received in the second seat 112 and engage the ledge 113, which can positively retain the second end 114 of the biasing member 60 in the second seat 112.

The second seat 112 and/or the second retaining wall 104 can have a circular shape, such as shown in FIGS. 5 and 8. As can be appreciated, the second seat 112 and/or the second retaining wall 104 can have other shapes or profiles to coordinate with or complement a shape of the biasing member 60.

As shown in FIGS. 5, 6 and 8, the locator 106 defines a protrusion or boss that projects away from the inner face 89 of the second support 86 and toward the inner face 85 of the first support 84. The locator 106, in the example shown, is an elongated and generally rectangular-shaped boss having a smooth arcuate surface. The locator 106 can be elongated in a direction substantially parallel to the longitudinal direction of the upper rail 56 and/or the frame header 36. A leading surface 107 of the locator 106 can have a rounded or tapered shape to assist the locator 106 in being directed toward and received or nested in the recess 98 of the upper support 84, as shown in FIG. 5. In other examples, the locator 106 can have other protruding shapes such as cylindrical, conical or frusto-conical which can complement the shape of the recess 98 of the upper support 84.

When the window vent 26 is in the closed position, the locator 106 can be aligned with the recess 98 on the upper support 84 as seen in FIG. 5. The locator 106 can move into the recess 98 of the upper support 84 as the window vent moves from the vented position to the closed position. The guide 90 assists in guiding the locator 106 into the recess 98. The locator 90 has a length and a width that are relatively smaller than a corresponding length and width of the recess 98. With this relative sizing, movement of the second support 86 in a longitudinal or transverse direction relative to the upper support 84 is limited when the window vent 26 is in the closed position and the locator 106 is engaged with the recess 98. Thus, in the closed position of the window vent 26, the locator 106 and recess 98 help to hold or lock the position of the top portion 42 of the window vent 26 relative to the window frame 24 at the upper end of the window assembly 22.

The lower support 86 can also include one or more attachment points 110. The attachment points 110 can be holes, recesses, slots or apertures that can accommodate fasteners (e.g., screws or rivets) or other attachment features such as clips, barbs, pins or the like that can be used to attach the second support 86 to the upper rail 56 of the window vent 26. In the example shown, the attachment points 110 are elongated holes or slots through which a fastener such as a screw, rivet, or the like can be inserted to retain the second support 86 to the upper rail 56. Moreover, the slots provide some adjustability for locating the lower support 86 when attaching the lower support 86 to the upper rail 56 of the window vent 26.

When the window vent assist mechanism 20 is in the compressed condition (FIG. 3), the first end 94 of the biasing member 60 is received in the first seat 92 of the upper support 84. In this condition, the first end 94 of the biasing member 60 bears directly against the frame header 36 of the window frame 24. The second end 114 of the biasing member 60 is, in turn, received in the second seat 112 and bears directly against the upper rail 56 of the window vent 26. Additionally, the second end 114 of the biasing member 60 is positively retained with the second seat 112 by the ledge 113. In this respect, as best seen in the exemplary embodiment shown in FIG. 3, the edge 115 of the ledge 113 extends into and between two adjacent coils of the biasing member 60 (which comprises a compression spring) thereby capturing the biasing member 60 in the second seat 112. Of course, the configuration could be modified such that the biasing member 60 is positively retained in the upper support 84 instead of and/or in addition to being positively retained in the lower support 86.

During routine operation of the window assembly 22 when the window vent assist mechanism 20 is in the relaxed condition (FIG. 4), the biasing member 60 maintains its engagement with the first seat 92 and second seat 112, respectfully. However, the window vent assist mechanism 20 does not prohibit the window vent 26 from being opened to a position beyond its normal vented position. In such situations, such as during installation of the window and/or the window vent assist mechanism 20, the first end 94 of the biasing member 60 can disengage from the first seat 92 while still being retained at its second end by the second seat 112. In this manner, continued opening movement of the window vent 26 is not prohibited by the window vent assist mechanism 20. Further, when the window vent 26 is thereafter returned to a closed position, the conical guide wall 91 of the first seat 92 can capture and direct the first end 94 of the biasing member within the first retaining wall 88 and into the first seat 92.

The upper support 84 and/or the lower support 86 can be made of any suitable rigid material to transfer the forces exerted by the biasing member 60 to the window frame 24 or the window vent 26, respectively. In one example, the lower support 84 and the upper support 86 are made of a suitable thermoplastic material. In other examples, other suitable materials such as other plastics, metals, or composites can be used.

In the example window assembly 22 shown in FIGS. 1 and 2, a single window vent assist mechanism 20 is used in the window assembly 22. In other examples, more than one window vent assist mechanism 20 can be used in the window assembly 22. For example, the window assembly 22 can include two window vent assist mechanism 20 spaced laterally apart from one another along the length of the upper rail 56. In another example, three window vent assist mechanisms 20 can be used. In examples in which two or more window vent assist mechanisms 20 are used, the window vent assist mechanisms 20 can be evenly spaced apart along the length of the frame header 36 and/or symmetrically positioned on the frame header 36 about a center position of the frame header 36. In this manner, the bias force imparted to the window vent 26 can be evenly distributed. In still other examples, any number of the window vent assist mechanisms 20 can be used so long as there is room along the frame header 36.

Figure 9:
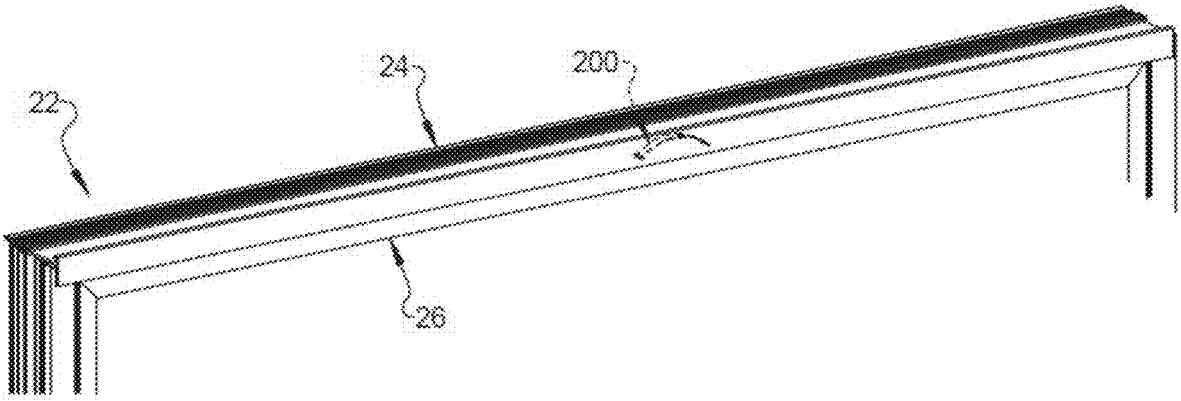
FIG. 9 shows a partial perspective view of the upper portion of another exemplary vent window including another window vent assist mechanism in accordance with the present disclosure.
Figure 10:
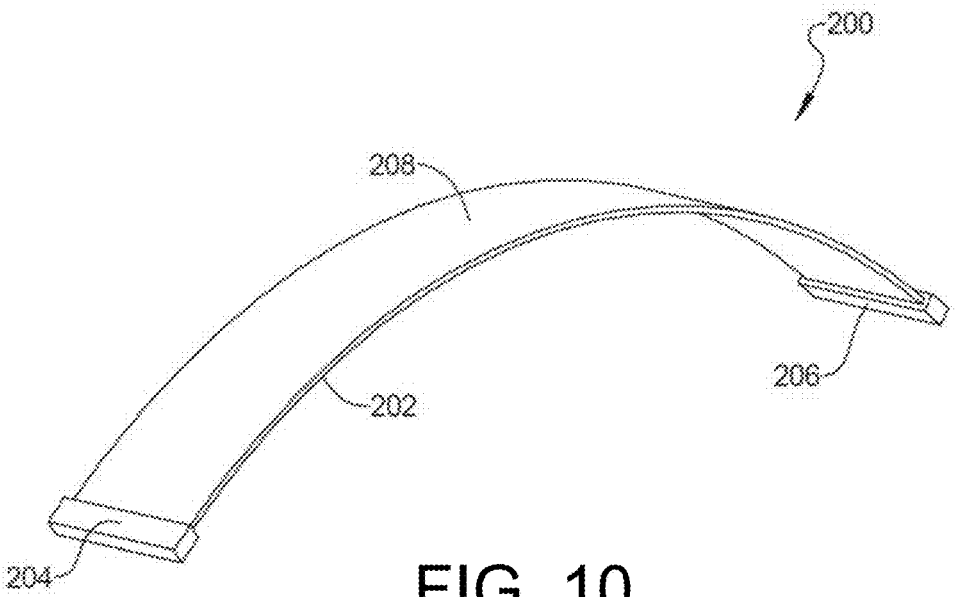
FIG. 10 is a perspective view of the window vent assist mechanism of FIG. 9.

In another example as shown in FIGS. 9 and 10, a window vent assist mechanism 200 is positioned between the window frame 24 and the window vent 26. The window vent assist mechanism 200 in this example can be a leaf spring 202. The leaf spring 202 can include a first end cap 204 and a second end cap 206 that are positioned at either end of the leaf spring 202. The leaf spring 202, in this example, can be positioned such that the leaf spring 202 is aligned along the longitudinal length of the upper rail 56 and/or the frame header 36. In this position, the leaf spring 202 bows upward from the upper rail 56 toward the frame header 36. An apex 208 of the leaf spring 202 can contact the frame header 36 and the first end cap 204 and the second end cap 206 can contact the upper rail 56.

In a manner similar to the window vent assist mechanism 20 previously described, the leaf spring 202 can exert a force against the window frame 24 and/or the window vent 26 to urge the window vent 26 to move relative to the window frame 24.

In the example shown in FIGS. 9 and 10, the window vent assist mechanism 200 includes one leaf spring 202. In other examples, the window vent assist mechanism 200 can includes two or more leaf springs 202 spaced longitudinally apart from one another along the upper rail 56. The window vent assist mechanism 200 can be used to cause the force required to move the window vent 26 to be equal to or less than the desired window operating force.

Figure 11:
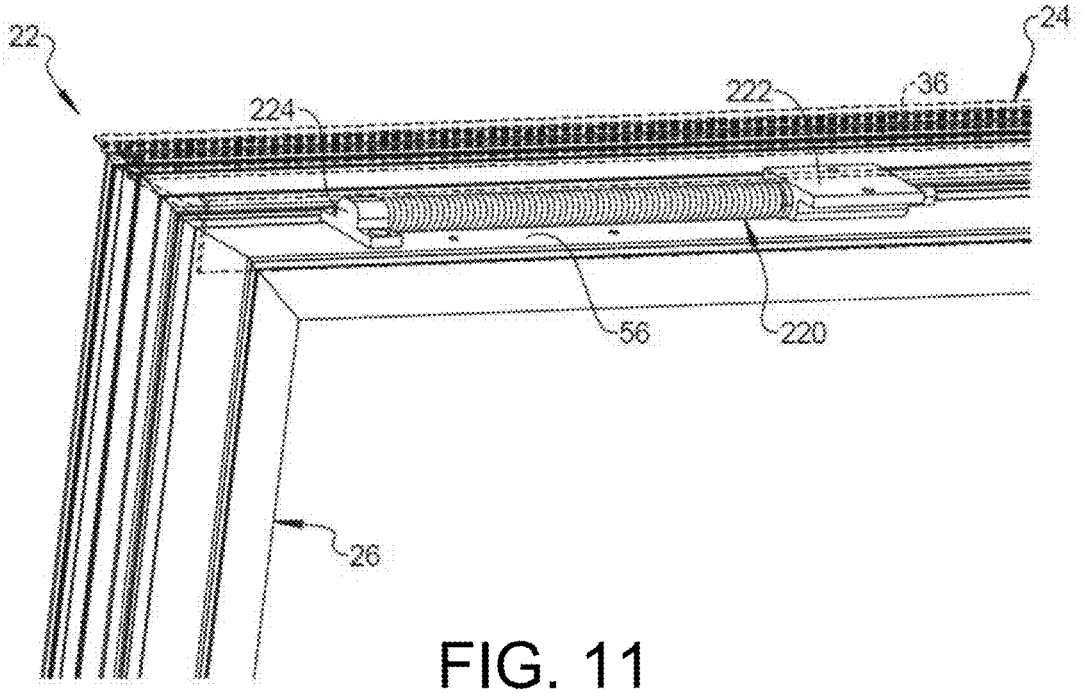
FIG. 11 shows a partial perspective view of the upper portion of another exemplary vent window assembly including still another window vent assist mechanism in accordance with the present disclosure.
Figure 12:
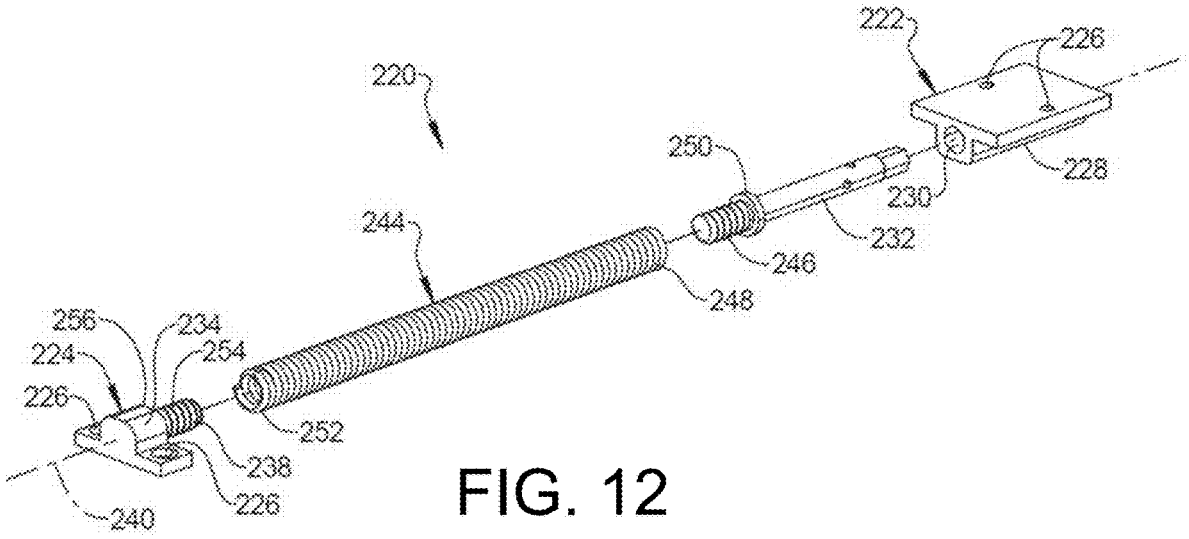
FIG. 12 is an exploded perspective view of the window vent assist mechanism of FIG. 11.

In another example shown in FIGS. 11 and 12, the window assembly 22 can include the window vent assist mechanism 220. The window vent assist mechanism 220, in this example, includes a first support 222 and a second support 224. The first support 222 is connected to the frame header 36 of the window frame 24. The second support 224 is connected to the upper rail 56 of the window vent 26. The first support 222 can be longitudinally spaced apart from the second support 224 along the longitudinal direction of the frame header 36 and/or the upper rail 56.

The first support 222 and/or the second support 224 can include one or more connection points 226 at which the first support 222 and/or the second support 224 is connected to the window frame 24 or the window vent 26, respectively. In the example shown, the first support 222 includes two connection points 226 and the second support 224 includes two connection points 226. Suitable fasteners such as screws, bolts, rivets or the like can be inserted through the connection points 226 to secure the first support 222 and/or the second support 224 in their relative positions. In other examples, other suitable attachments can be used such as pins, clips, adhesive, welds, stakes or the like.

The first support 222 can include a first collar 228 that projects upward from the first support 222. The first collar 228 can define a first seat or sleeve 230 that is configured to receive a first rod 232 therein. In the example shown, the first sleeve 230 and the first rod 232 have round cross-sectional profiles. In other examples, other shapes or profiles can be used.

In a complimentary and cooperating arrangement, the second support 224 includes a second collar 234. The second collar 234 can define a second seat or sleeve (not shown) that is configured to receive a second rod 238 therein. The second sleeve and the second rod 238 can also have round cross-sectional profiles. The second sleeve and the second rod 238 can be axially aligned with the first sleeve 230 and the first rod 232 along a longitudinal axis 240. The second rod 238 can also be formed as part of the second support 224 (as shown in FIG. 12) and/or the second collar 234 rather than being a separate rod that is received into the second sleeve.

The window vent assist mechanism 220, as further shown in FIGS. 11 and 12, include the biasing member 244. In this example, the biasing member is a torsion spring 244 that extends between the first support 222 and the second support 224. The torsion spring 244 is secured to the first support 222 by the first rod 232 and to the second support 224 by the second rod 238. The first rod 232 can include a first threaded portion 246. A first end 248 of the torsion spring 244 can be threaded or otherwise attached to the first threaded portion 246 until the first end 248 abuts a first stop 250 adjacent to the first threaded portion 246. Similarly, a second end 252 of the torsion spring 244 can be threaded or otherwise attached to a second threaded portion 254 on the second rod 238 until the second end 252 abuts a second stop 256 adjacent to the second threaded portion 254.

In the example shown, the torsion spring 244 can be installed between the first support 222 and the second support 224. A torque can then be applied to the torsion spring 244 via the first rod 232 and/or the second rod 238 by rotating the first rod 232 and/or the second rod 238 relative to the other. In this manner, the torsion spring 244 exerts a rotational force against the first support 222 and/or the second support 224. The rotational force of the torsion spring 244 causes the second support 224 to urge the window vent 26 to move relative to the window frame 24. As such, the window vent assist mechanism 220 can be used to exert a force against the window vent 26 to reduce the force required to move the window vent 26 from the closed position to the vented position.

As can be appreciated, the previously described example window vent assist mechanisms 20, 200, 220 can be used in other window configurations to reduce a force required to move the window vent 26 from the vented position to the closed position. In such alternate configurations, the biasing member 60 (e.g., the coil spring, the leaf spring or the torsion spring) can be reconfigured to exert a force in a direction opposite to the previously described examples such that the biasing member exerts a force to urge the window vent 26 to move toward the window frame 24 to move the window vent 26 from the vented position to the closed position.

For example, in the example window vent assist mechanism 20, the coil spring can be configured such that when the window vent is in the closed position, the coil spring is in a relaxed state and is stretched when the window vent 26 is moved to the vented position. In such a configuration, the coil spring exerts a force on the window vent 26 that urges the window vent 26 to move toward the closed position. As can be appreciated, the leaf spring and/or the torsion spring of the example window vent assist mechanisms 200, 220, respectively can be configured to reverse the direction of their respective biasing forces.

Figure 13:
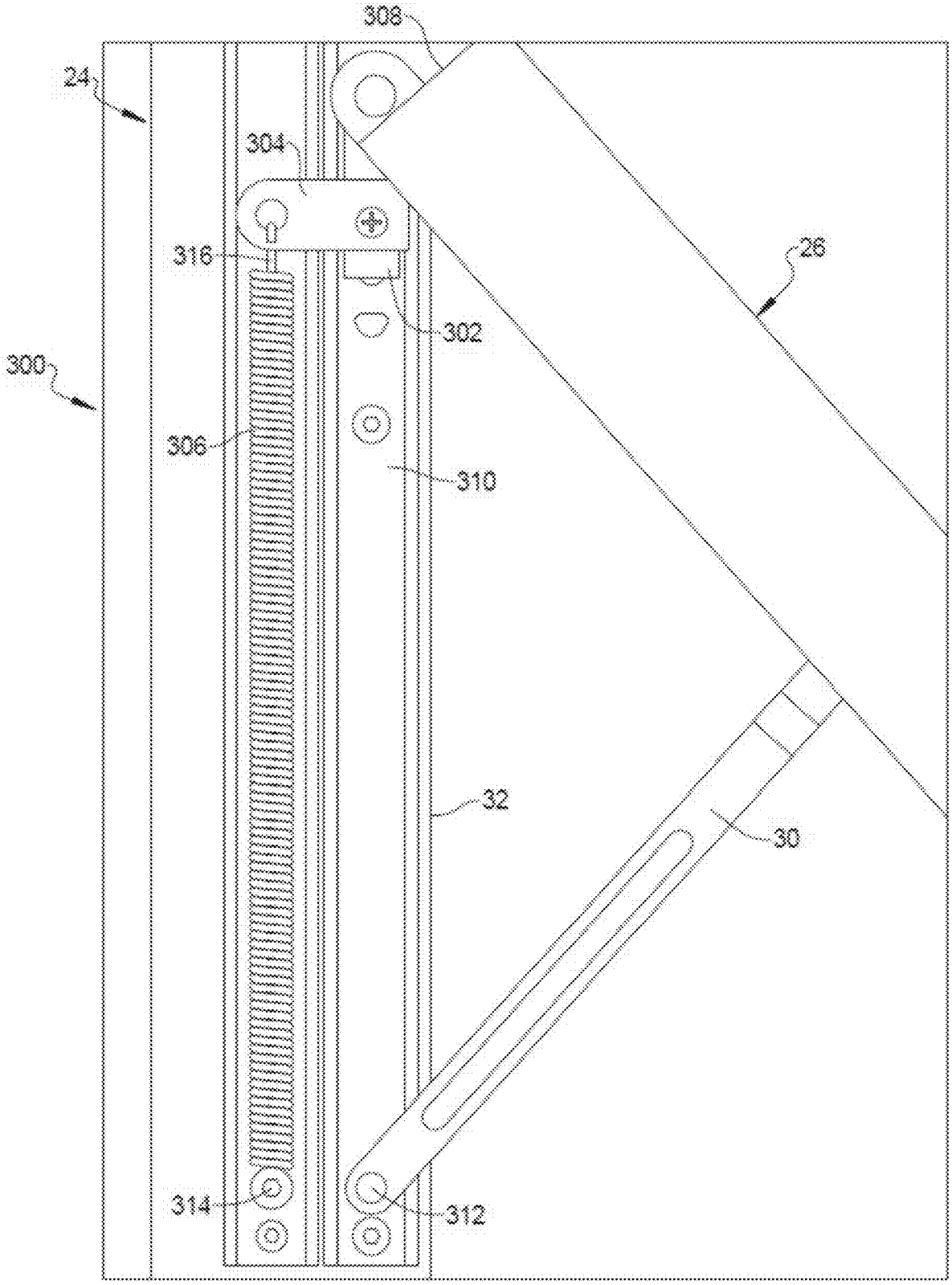
FIG. 13 shows a partial side view of another exemplary vent window assembly including yet another window vent assist mechanism in accordance with the present disclosure.

In still another example shown in FIG. 13, a window vent assist mechanism 300 can be positioned in one or both vertical sides 32 of the window frame 24. As shown in FIG. 13, the window vent assist mechanism 300 can include a slider 302, an extension arm 304 and a spring 306. The window vent assist mechanism 300 can be used in an awning type window in which the window vent 26 is attached to the window frame 24 by the hinge 30. A top 308 of the window vent 26, in this window assembly, is configured to slide along a track 310 when the window vent 26 is moved from the closed position to the vented position (as shown). The track 310 can be vertically aligned along the vertical side(s) of the window frame 24. As can be appreciated, the slider 302 (and the top 308 of the window vent 26) moves downward in the track 310 when the window vent 26 is moved to the vented position. This movement of the slider 302 occurs because the lower pivot 312 of the hinge 30 is fixed in the vertical side 32 of the window frame 24.

The spring 306 is fixed to the vertical side 32 of the window frame at a fixed end 314. An opposite end 316 of the spring 306 is connected to the extension arm 304. The extension arm 304 can be, in turn, connected to the slider 302. In this configuration, the spring 306 can be extended when the slider 302 moves upward in the track 310 and compressed when the slider 302 moves downward in the track 310. In such a manner, the spring 306 can exert a force on the slider 302 to move the slider 302 in the track 310.

As previously described, the position of the center of gravity of the window vent 26 relative to the position of the hinge 30 can cause the weight of the window vent 26 to urge the window vent 26 to move to the closed position. In such instances, the force required to move the window vent 26 to the vented position can exceed the desired window operating force. The spring 306 is connected at the fixed end 314 and at the opposite end 316 such that the spring 306 is in the relaxed (or un-extended) state when the window vent 26 is in the vented position. When the window vent 26 is moved to the closed position, the opposite end 316 moves upward with the slider 302 and the extension arm 304 to extend the spring to an extended state. In the extended state, the spring 306 can exert a force on the extension arm 304 and, in turn, on the slider 302 to urge the window vent 26 to move downward toward the vented position. In such a manner, the window vent assist mechanism 300 can assist in moving the window vent 26 between the closed position and the vented position and reduce the force required to move the window vent 26 to the vented position to a force less than or equal to the desired window operating force.

Figure 14:
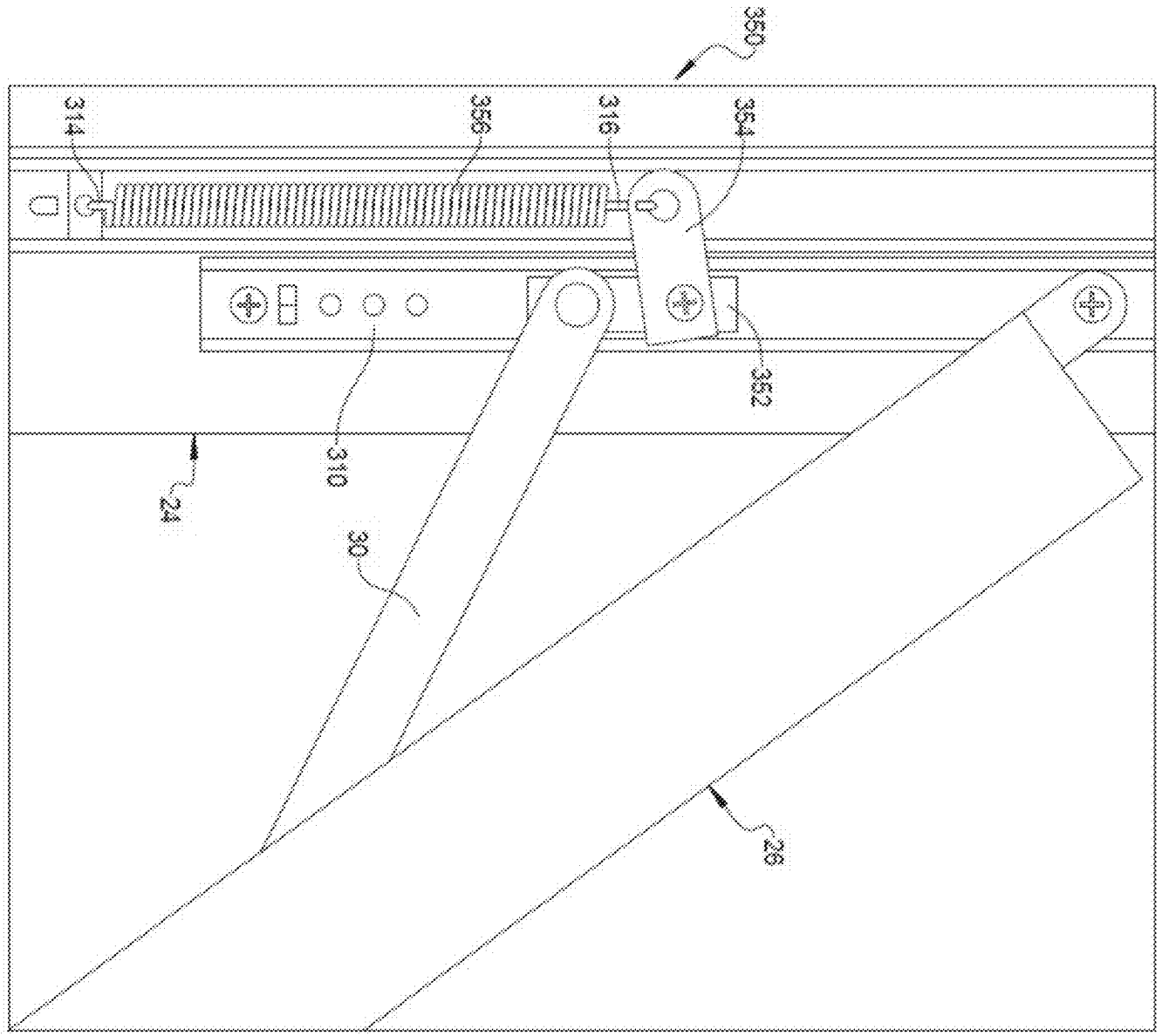
FIG. 14 shows a partial side view of another exemplary vent window assembly including yet another window vent mechanism in accordance with the present disclosure.

Another example window vent assist mechanism is shown in FIG. 14. The example window vent assist mechanism 350 is similar to the window vent assist mechanism 300 previously described. In this example, however, the window vent 26 is vertically fixed to the window frame 24. The window vent 26 can rotate relative to the window frame 24 but the window vent 26 does not move vertically in the window frame 24. The window vent assist mechanism 350, in this example, includes a slider 352, an extension arm 354 and a spring 356. In this example, the slider 352 moves in the track 310 when the window vent 26 moves from the closed position to the vented position.

In a similar manner to that previously described with respect to window vent assist mechanism 300, the spring 356 is connected at the fixed end 314 to the vertical side 32. The opposite end 316 of the spring 356 is connected to the slider 352 via the extension arm 354. In the vented position, the spring 356 is in a relaxed (un-extended) state. As the window vent 26 moves from the vented position to the closed position, the slider 352 moves upward causing the spring 356 to move to an extended state. In the closed position, the spring 356 is in the extended state and exerts a force on the extension arm 354 and the slider 352 urging the hinge 30 to move downward to cause the window vent 26 to move to the vented position.

In this manner, the window vent assist mechanism 350 can assist in moving the window vent 26 between the closed position and the vented position and reduce the force required to move the window vent 26 to the vented position. The window vent assist mechanism 350 can be used to reduce a force required to operate the window vent 26 to a force less than or equal to the desired window operating force.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

What is claimed is:

1. A window vent assist for a vent window having a window frame and a window vent disposed in the window frame and moveable between a closed position and an opened position, the window vent assist reducing an operating force required to move the window vent relative to the window frame from the closed position to the opened position, the window vent assist comprising:

a first support plate configured to attach to a header of the window frame;

a second support plate configured to attach to an upper rail of the window vent disposed in the window frame;

a biasing member disposed intermediate the first support plate and the second support plate;

wherein the first support plate comprises a first seat for receiving a first end of the biasing member;

wherein the second support plate comprises a second seat for receiving and retaining a second end of the biasing member;

wherein the window vent assist is moveable between a biased condition wherein when the window vent is in the closed position and an unbiased condition when the window vent is in the opened position;

wherein when the window vent assist is in the biased condition the first support plate and the second support plate are positioned in an opposed relationship such that the first seat and the second seat are co-axially aligned along a vertical axis; and wherein the biasing member imparts a force against the first support plate and the second support plate to urge the second support plate away from the first support plate.

2. The window vent assist of claim 1, wherein the first support plate comprises a first inner side;

wherein the first seat comprises a first opening extending through the first support plate along the vertical axis, the first opening being defined by a first retaining wall extending about a perimeter of the first opening and a conical guide wall disposed between the first retaining wall and the first inner side, a surface of the conical guide wall being disposed at an acute angle relative to the vertical axis; and wherein the first end of the biasing member is disposed in the first opening.

3. The window vent assist of claim 2, wherein the second support plate comprises a second inner side;

wherein the second seat comprises a second opening extending through the second support plate along the vertical axis, the second opening being defined by a second retaining wall extending about a perimeter of the second opening and a ledge extending from the second retaining wall into the opening, the ledge terminating at an edge portion;

wherein the second end of the biasing member is disposed in the second opening;

wherein the ledge engages the biasing member to retain the biasing member in the second seat.

4. The window vent assist of claim 3, wherein the biasing member defines an outer perimeter; and wherein the edge portion of the ledge intersects the outer perimeter.

5. The window vent assist of claim 3, wherein the biasing member comprises a compression coil spring; and wherein the ledge extends between two adjacent coils of the compression coil spring to retain the biasing member in the second seat.

6. The window vent assist of claim 3, wherein the second support plate further comprises a boss projecting from an inner surface of the second support plate and toward the first support plate;

wherein the first support plate comprises a recess;

wherein when the window vent assist is in the biased condition the boss is received in the recess in a nesting relationship.

7. The window vent assist of claim 3, wherein the first seat and the second seat are both generally cylindrically-shaped.

8. A vent window assembly comprising an outer side, an inner side, the window frame, the window vent disposed in the window frame and moveable from the closed position and the opened position and the window vent assist of claim 1.

9. The vent window assembly of claim 8;

wherein the window vent comprises a horizontal upper rail, a horizontal lower rail, opposing vertical stiles and a plurality of panes of glass;

wherein the first support plate is attached to the header and the second support plate is attached to the upper rail of the window vent such that the vertical axis is laterally offset from a vertical plane in which a center of gravity of the window vent is located and is located closer to the inner side of the vent window assembly than the vertical plane.

10. A window vent assist for use with a vent window assembly having a window vent operable between a closed position and a vented position, the window vent assist comprising:

a first support configured to attach to a window frame and comprising a first seat;

a second support configured to connect to the window vent disposed in the window frame and comprising a second seat; and a biasing member disposed between the first support and the second support, the biasing member having opposed first and second ends, the first end being received in the first seat, the second end being received in the second seat;

wherein the window vent assist operates in and between a biased condition and an unbiased condition;

wherein when the window vent assist is in a biased condition, the biasing member is configured to exert a force urging the window vent toward the vented position;

wherein the first support comprises a first inner side;

wherein the first seat comprises a first opening extending through the first support, the first opening being defined by a first retaining wall extending about a perimeter of the first opening and a conical guide wall disposed between the first retaining wall and the first inner side, a surface of the conical guide wall being disposed at an acute angle relative to a vertical axis;

wherein the first end of the biasing member is disposed in the first opening;

wherein the second support comprises a second inner side;

wherein the second seat comprises a second opening extending through the second support, the second opening being defined by a second retaining wall extending about a perimeter of the second opening and a ledge extending from the second retaining wall into the opening, the ledge terminating at an edge portion;

wherein the second end of the biasing member is disposed in the second opening;

wherein the first seat and the second seat are aligned along an axis when the window vent assist is in the biased condition; and wherein the ledge engages the biasing member to retain the biasing member in the second seat.

11. The window vent assist of claim 10, wherein the second support comprises a locator projecting outward toward the first support and the first support comprises a recess configured to receive the locator when the window vent is in the closed position, the locator limiting movement of the second support relative to the first support when the window vent is in the closed position.

12. The window vent assist of claim 11, wherein the biasing member comprises a compression coil spring.

13. A vent window assembly comprising:

an inner side and an outer side;

a window frame configured to mount to a structure, the window frame defining a window opening and including a header;

a window vent pivotally connected to the window frame, the window vent operable in a closed position to substantially cover the window opening and in a vented position in which the window vent is oriented at an oblique angle relative to a plane of the window opening, the window vent including an upper rail;

a biasing member positioned between the header of the window frame and the upper rail of the window vent, the biasing member operable in and between a biased condition and an unbiased condition;

wherein the biasing member is laterally offset from and closer to the inner side of the vent window assembly than a center of gravity of the window vent; and wherein, in the biased condition, the biasing member exerts a force on the window vent to urge the window vent from the closed position toward the vented position.

14. The vent window assembly of claim 13, wherein the biasing member comprises a compression coil spring positioned between the header of the window frame and the upper rail of the window vent;

wherein, in the biased condition, the compression coil spring exerts a force along a vertical axis generally perpendicular to the header of the window frame;

wherein the vertical axis is laterally offset from and closer to the inner side of the vent window assembly than the center of gravity of the window vent.

15. The vent window assembly of claim 13, wherein the biasing member comprises a plurality of compression coil springs positioned between a frame head of the window frame and the upper rail of the window vent;

wherein, in the biased condition, each compression coil spring exerts a force along a respective vertical axis generally perpendicular to the header of the window frame; and wherein each respective vertical axis is laterally offset from and closer to the inner side of the vent window assembly than the center of gravity of the window vent.

16. The vent window assembly of claim 13, wherein the biasing member comprises a torsion spring extending longitudinally in a direction substantially parallel to the header of the window frame, the torsion spring connected at a first end to a first support and at a second end to a second support;

wherein the first support is connected to the header of the window frame and the second support is connected to the upper rail of the window vent; and wherein, in the biased condition, the torsion spring exerts a torque about a horizontal axis;

wherein the horizontal axis is laterally offset from and closer to the inner side of the vent window assembly than the center of gravity of the window vent.

17. The vent window assembly of claim 13, wherein the biasing member comprises a leaf spring positioned between the header of the window frame and the upper rail of the window vent;

wherein the leaf spring includes a first end, a second end and a center portion, the first end and the second end being connected to the upper rail of the window vent and the center portion protruding away from the upper rail and toward the header of the window frame;

wherein, in the biased condition, the leaf spring exerts a force extending along a vertical axis generally perpendicular to the header of the window frame;

wherein the vertical axis is laterally offset from and closer to the inner side of the vent window assembly than the center of gravity of the window vent.

18. The vent window assembly of claim 17, wherein the biasing member comprises a plurality of leaf springs positioned along a longitudinal extent of the upper rail of the window vent;

wherein each leaf spring includes a first end, a second end and a center portion, each first end and each second end being connected to the upper rail of the window vent and each center portion protruding away from the upper rail and toward the header of the window frame;

wherein, in the biased condition, each leaf spring exerts a respective force extending along a respective vertical axis generally perpendicular to the header of the window frame;

wherein each respective vertical axis is laterally offset from and closer to the inner side of the vent window assembly than the center of gravity of the window vent.

* * * * *